137-13 SR
3/20/84 XR 4,437,519

United States Patent [19]
Cha et al.
[11] 4,437,519
[45] Mar. 20, 1984

[54] REDUCTION OF SHALE OIL POUR POINT

[75] Inventors: Chang Y. Cha; Harry E. McCarthy, both of Golden, Colo.

[73] Assignee: Occidental Oil Shale, Inc., Grand Junction, Colo.

[21] Appl. No.: 269,987

[22] Filed: Jun. 3, 1981

[51] Int. Cl.[3] ..... E21B 43/247; E21B 43/34; C10G 1/02

[52] U.S. Cl. ..... 166/259; 137/13; 166/266; 166/267; 208/11 R; 208/15

[58] Field of Search ..... 208/11 R, 14, 15; 137/3, 4, 13; 166/256, 259, 266, 267; 299/2

[56] References Cited

U.S. PATENT DOCUMENTS

| | | | |
|---|---|---|---|
| 2,664,388 | 12/1953 | Winterhalter | 208/15 |
| 3,025,223 | 3/1962 | Aspegren et al. | 208/14 |
| 3,284,336 | 11/1966 | Culbertson, Jr. et al. | 208/11 R |
| 3,507,776 | 4/1970 | Hann | 208/15 X |
| 3,523,071 | 8/1970 | Knapp et al. | 208/14 |
| 3,532,618 | 10/1970 | Wunderlich | 208/14 |
| 3,738,931 | 6/1973 | Frankovich et al. | 208/11 R X |
| 3,767,564 | 10/1973 | Youngblood et al. | 208/15 X |
| 3,776,247 | 12/1973 | Choufoer et al. | 137/13 |
| 3,853,497 | 12/1974 | Miller et al. | 137/13 X |
| 4,172,026 | 10/1979 | Jensen | 208/14 |
| 4,181,177 | 1/1980 | Compton | 208/14 X |

OTHER PUBLICATIONS

Berry, "Combined Retorting Technique for Oil Shale", *Chemical Engineering Progress,* Sep. 1979, pp. 72–77.
Baughman et al., "Shale Oil Recovery Methods", *Mining Engineering,* Jan. 1981, pp. 43–44.
Lovell and Seitzer, "Some Flow Characteristics of Utah Shale Oils", pp. 213 to 220.

*Primary Examiner*—George A. Suchfield
*Attorney, Agent, or Firm*—Christie, Parker & Hale

[57] ABSTRACT

A portion of crude shale oil produced from an in situ oil shale retort is blended with shale oil produced from a Tosco II retorting process to produce a blended shale oil composition having a pour point lower than the pour point of the shale oil produced from the Tosco II retorting process.

14 Claims, 7 Drawing Figures

IN SITU
TOSCO II
UENSEN TREATED
UENSEN RAW
PARAHO
UENSEN RAW
UENSEN TREATED
60
62
64
wt %
CARBON NUMBER 66
68
70
72
wt %
CARBON NUMBER

REDUCTION OF SHALE OIL POUR POINT

BACKGROUND OF THE INVENTION

The presence of large deposits of oil shale in the semiarid high plateau region of the Western United States has given rise to extensive efforts to develop methods for recovering shale oil from kerogen in formations containing oil shale. It should be noted that the term "oil shale" as used in the industry is in fact a misnomer, it is neither shale nor does it contain oil. It is a sedimentary formation comprising a marlstone deposit with layers containing an organic polymer called "kerogen" which upon heating thermally decomposes to produce liquid and gaseous products. It is the formation containing kerogen that is called "oil shale" herein, and the liquid product produced by the decomposition of the kerogen is called "shale oil."

A number of methods have been proposed for processing oil shale which involved either first mining the oil shale and processing the oil shale above ground, or processing the oil shale in situ. The latter approach is preferable from the standpoint of environmental impact since the spent shale remains in place, reducing the chance of surface contamination and the requirements for disposal of solid waste.

Many of the methods for shale oil production are described in *Synthetic Fuels Data Handbook,* 2nd ed., compiled by Dr. Thomas A. Hendrickson, and published by Cameron Engineers, Inc., Denver Colo. Above ground retorting processes include those known as Tosco II, Paraho direct, Paraho indirect, N-T-U, and Bureau of Mines, Rock Spring processes.

The Tosco II retorting process is described in pp. 85–88 of the *Synthetic Fuels Data Handbook* and U.S. Pat. No. 3,025,223. Briefly, this process involves preheating minus one-half inch oil shale particles to about 500° F. in an entrained bed lift pipe. The preheated oil shale particles are then introduced to a rotating pyrolysis drum. The heat for retorting the oil shale particles is provided by heated ceramic balls which are separately heated in a ball heating furnace and introduced to the rotating drum. The ceramic balls are heated to a temperature of about 1200° F. and are provided to the pyrolysis drum in an amount sufficient to heat the oil shale particles to about 900° F.

The Paraho process is described at pp. 100–104 of the *Synthetic Fuels Data Handbook* and the U.S. patents referred to therein. The Paraho process employs a vertical kiln through which ground oil shale moves downwardly as gas moves upwardly. Combustion air can be admitted into the bed of oil shale particles for direct heating of the oil shale by combustion within the bed. This process is referred to as Paraho direct. The kiln can also be arranged so that recycled gas can be heated externally, then injected into the bed of oil shale for indirect heating of the oil shale. Such a process is referred to as the Paraho indirect process. The N-T-U process is a batch process which is described at pp. 67–72 of the *Synthetic Fuels Data Handbook* and the United States patents referred to therein. In the N-T-U process, a retort is filled with a batch of oil shale particles and ignited at the top. Combustion is supported by air injection and a combustion zone is passed downwardly through the stationary bed of oil shale particles. Recycled gas from the bottom of the retort is mixed with the combustion gas to modulate temperatures and provide some of the fuel requirement. Other above-ground oil shale retorting processes described in the *Synthetic Fuels Data Handbook* include the gas combustion process on p. 72; the Kiviter process on p. 76; the Petrosix process described on p. 80; the Lurgi-Ruhrgas process described on p. 81; Superior Oil process described on p. 88; the Galoter process described on p. 90; the Institute of Gas Technology process using hydrogen retorting described on p. 92; and the Union Oil process described on p. 95.

Various in situ oil shale retorting processes are disclosed. Beginning on p. 104 of the *Synthetic Fuels Data Handbook.*

The Bureau of Mines, Rock Springs process is described in Paper No. SPE-6067, by R. L. Wise et al, prepared for the 51st annual technical conference and exhibition of the Society of Petroleum Engineers of AIME, held in New Orleans, Oct. 3 to the 6th, 1976. Such a process is also described in U.S. Pat. No. 3,346,044, among others. Generally, this process involves fracturing of an underground oil shale formation and propping the fractions open with sand. Injection and production wells are drilled into the fractured formation. A combustion zone is moved from an injection well towards one or more production wells for retorting oil shale in the fractured formation.

The liquid oil product recovered from the retorting processes and which is the result of the thermal decomposition of the organic material, kerogen, in the oil shale is referred to as shale oil. The properties of the crude shale oil product from a retorting process are dependent on a variety of factors which occur during the retorting process. One of the most important of these factors is temperature, or more specifically, temperature history. Not only is the retorting temperature important, but the rate at which the oil shale was heated to this temperature and the time at which it is kept at the retorting temperature are of concern. The temperature to which the shale oil vapors are heated after they are generated is a factor affecting the properties of shale oil, as well as the length of time such vapors are exposed to this temperature.

Generally, the crude shale oil tends to thicken when cooled and progressively becomes increasingly resistant to flow in the fluid handling operations, such as pumping through a pipeline. However, there is little or no relation between the viscosity and the pour point of a particular shale oil. The temperature at which the shale oil changes from a flowable to a nonflowable state, as measured by ASTM D97, is called the pour point. At temperatures from slightly above the pour point to below the pour point, the shale oil can be difficult or impossible to pump, requiring the use of costly heated pipelines, tank cars and the like. The transportation of such shale oil is thus hindered, particularly in colder months. Because shale oil is produced from oil shale deposits located far from population centers and refining facilities in areas of the Western United States subject to severe winters, practical methods for regulating the pour point of shale oil are needed.

The pour point of shale oil preferably should be low enough to allow the oil to be pumped through pipelines. Higher pour points are acceptable in warmer climates or warmer months of the year, and conversely lower pour points are required when cooler temperatures prevail. It is considered that, in the Piceance Creek Basin of Western Colorado during the winter months, shale oil having a pour point lower than 20° F. can generally be pumped satisfactorily, even though prevailing temperatures can be much below 20° F. This is because the shale is warm, e.g., above about 100° F. when it is withdrawn from an in situ oil shale retort. The warm oil can be pumped and once it is flowing it can continue to flow when its temperature drops below its pour point. However, if the flow of oil is interrupted, it can set up to an unpumpable state if cooled below its pour point and warming can be required before pumping can be resumed.

One method of lowering the pour point of high pour point shale oils which may be exposed to low temperatures is to add a pour point depressant to the shale oil. A pour point depressant can be any additive that is effective for lowering the pour point of the shale oil. Various pour-point depressants are known and have been used successfully, mostly with middle distillate fuels. Some of the known pour-point depressants can be expensive and some may need to be used in such large amounts that they undesirably effect the shale oil product. For example, pour-point depressants may need to be removed prior to further refining or processing of the shale oil. A further difficulty with pour-point depressants is that the influence on the pour point of a shale oil by any particular substance is unpredictable. This unpredictability is generally thought to be due to structural differences of the paraffins occurring in the various shale oils which differences are derived from different sources or locations and retorting methods.

Various pour-point depressants are disclosed in the art. For example, as disclosed hereinafter, various pour-point depressants can be made from shale oil and other sources. Use of particular polymers as pour-point depressants for residium-containing oils and heavy petroleum fractions is known for example, see U.S. Pat. Nos. 3,567,639 and 3,817,866.

U.S. Pat. No. 3,523,071 to Knapp et al teaches that the heavy fraction produced from visbreaking raw shale oil is an effective pour-point depressant by hydrodenitrogenated shale oil.

U.S. Pat. No. 3,532,618 of Wunderlich et al discloses hydrovisbreaking shale oil and deasphalting the visbroken shale oil to produce a deasphalted shale oil of intermediate pour point and an asphaltine portion which can have utility as a pour-point depressant for shale oil.

U.S. Pat. No. 3,369,992 discloses converting a high wax, high pour point oil into a low pour point synthetic crude oil by separating the high pour point oil into a virgin distilate and a reduced crude, coking the reduced crude and combining a middle fraction of the coker distillate with the virgin distillate to produce a low pour point product.

U.S. Pat. No. 4,029,571 discloses reducing the pour point of a synthetic crude oil by hydrovisbreaking or visbreaking the oil. The hydrovisbroken or visbroken oil exhibits a reduced pour point from that of the crude oil.

U.S. Pat. No. 3,738,931 discloses hydrovisbreaking shale oil, separating and hydrogenating the visbroken vapors and combining them with the visbroken liquid to produce a shale oil having a reduced pour point.

U.S. Pat. No. 3,284,336 to Culbertson, Jr. et al discloses separating shale oil into heavy and light fractions, thermally treating only the heavy fraction at a temperature from 600° F. to below the point of thermal decomposition, and recombining the thermally treated fraction with the light fraction to give a product having a reduced pour point.

U.S. Pat. No. 4,201,658 to Jensen discloses that a pour-point depressant can be formed by thermally treating a raw whole shale oil in substantially liquid phase at a temperature from 600° F. to below the point of significant thermal decomposition to form a thermally treated shale oil. The thermally treated shale oil is then deasphalted by mixing with a deasphalting solvent. The insoluable asphaltine component has utility as a pour-point depressant.

U.S. Pat. No. 4,181,177 of Compton, discloses that a blended shale oil composition can be formed which has a pour point different from a crude shale oil. The process of changing the pour point of crude shale oil as disclosed in the patent is practiced on a crude shale oil produced by in situ retorting of oil shale. The crude shale oil obtained from the in situ retort is fractionated to produce either a low boiling fraction, a paraffinic fraction, or a high boiling fraction having a relatively higher paraffin content than the overall paraffin content of the shale oil. Such fractions of the crude shale oil can each be blended with crude shale oil to provide a blended shale oil composition having a pour point within the range for convenient handling.

As disclosed in the *Synthetic Fuels Data Handbook*, the pour point of crude shale oil produced by above ground retorting of oil shale is relatively high, i.e., about 60–90° F. In Table 75 on p. 115 of the *Synthetic Fuels Data Handbook*, the processes for producing shale oil and the pour point of the shale oil produced by such processes are given as follows: N-T-U, 80°; N-T-U, 90°; N-T-U, 70°; gas combustion, 83.5°; gas combustion, 85°; Tosco II, 80°; Union, 80°; Union, "V", 60°; Paraho, 85°; Hydrotort, 65°; and Catalytic Hydrotort, 75°.

It would be desirable to have a method for reducing the pour point of such above ground process-produced shale oils to provide a pipelineable and storable shale oil.

SUMMARY OF THE INVENTION

The present invention is directed to a method for lowering the pour point of a shale oil produced from a Tosco II retorting process. Generally, a shale oil produced from a Tosco II retorting process has a relatively high pour point making storage and transportation of such a shale oil difficult. To reduce the pour point of such a shale oil from a Tosco II retorting process, the Tosco II shale oil is blended with a crude shale oil produced by in situ retorting of oil shale in a subterranean in situ oil shale retort.

A crude shale oil having utility herein for blending with such a Tosco II process-produced shale oil is produced from an in situ oil shale retort by advancing a combustion zone through a fragmented permeable mass of particles containing oil shale within the in situ oil shale retort by introducing an oxygen-supplying gas into the fragmented mass on the trailing side of the combustion zone and withdrawing an off-gas from the fragmented mass on the advancing side of the combustion zone. The combustion gas flowing through the combustion zone transfers heat of combustion to a retorting zone in the fragmented mass on the advancing side of the combustion zone. The organic material, kerogen, in the oil shale within the fragmented mass in the retorting zone is decomposed to produce gaseous and liquid products including crude shale oil. The crude shale oil is withdrawn from the in situ oil shale retort.

A portion of such crude shale oil produced from an in situ oil shale retort is blended with shale oil produced from a Tosco II retorting process to produce a blended shale oil composition having a pour point lower than the pour point of the shale oil produced from the Tosco II retorting process.

The amount of in situ process-produced crude shale oil that is blended with the Tosco II process-produced shale oil can be any amount sufficient for lowering the pour point of the Tosco II process-produced shale oil to an acceptable pour point. The pour point of the in situ process-produced crude shale oil can vary appreciably with the technique used for producing the shale oil and the height of the in situ retort. However, if the pour point of the in situ process-produced crude shale oil is less than the pour point of the Tosco II process-produced shale oil, it has the effect of lowering the pour point of the Tosco II process-produced shale oil upon blending the two shale oils. The blended shale oil composition can have a pour point lower than either the crude in situ process-produced shale oil and the Tosco II process-produced shale oil.

DETAILED DESCRIPTION OF THE INVENTION

The invention herein concerns modifying the pour point of shale oil produced from a Tosco II retorting process to facilitate its transportation and processing. When a crude shale oil produced from a Tosco II retorting process has a pour point too high for convenient handling under prevailing temperatures, it can be blended with a crude shale oil produced by in situ retorting of oil shale in a subterranean in situ oil shale retort to produce a blended shale oil composition having a pour point lower than the pour point of the crude Tosco II process-produced shale oil.

Figure 1:
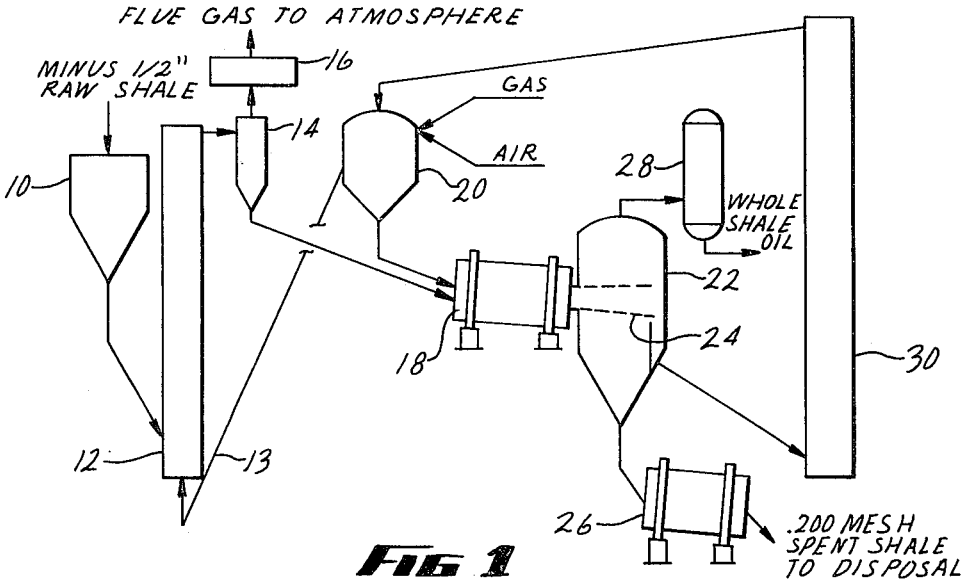
FIG. 1 is a flow diagram schematically representing a configuration of a Tosco II retorting process for oil shale.

The basic Tosco II retorting process is schematically represented by the flow diagram in FIG. 1. A detailed description of the Tosco II process can be found in U.S. Pat. No. 3,025,223, the entire disclosure of which is incorporated herein by this reference.

With reference to FIG. 1, the Tosco II process is practiced by comminuting and crushing a raw oil shale to minus one-half inch. The crushed and sized oil shale is fed to and stored in a surge hopper 10. From the surge hopper 10 the sized oil shale is transferred to an entrained bed lift pipe 12. In the fluidized bed lift pipe the sized oil shale is preheated with hot flue gas 13 to a temperature of about 500° F. The oil shale in then transferred to a separator 14 wherein the preheated oil shale is separated from the fluidizing gas. The fluidizing gas can be passed through a scrubber 16 and vented to the atmosphere.

The preheated oil shale particles are fed to a pyrolysis drum 18. In the pyrolysis drum the preheated, sized raw oil shale particles are mixed with hot ceramic balls as a source of heat for the pyrolysis step. During the pyrolysis step the kerogen in the oil shale particles decomposes to produce liquid and gaseous products including crude shale oil. The ceramic balls are about three-fourths of an inch in diameter. The ceramic balls are heated in a ball heater 20 to a temperature of approximately 1200° F. The heated ceramic balls are then charged to the pyrolysis drum to mix with the incoming preheated and sized oil shale particles in a proportion of about two tons of balls for every one ton of oil shale. The pyrolysis drum is capable of rotation and as it rotates, the ceramic balls come into contact with the oil shale particles heating the particles to approximately 900° F.

The gaseous products produced during the pyrolysis step, the spent shale particles, and the ceramic balls exit the pyrolysis drum and are separated in an accumulator vessel 22. The ceramic balls and the spent oil shale particles are separated by a trommel 24 within the accumulator vessel. The trommel is a heavy-duty rotating cylinder with numerous holes extending through the wall. The trommel operates within the seal of the accumulator vessel. The holes in the cylinder wall of the trommel are sufficiently large to permit the passage of the spent oil shale particles but sufficiently small to prevent the passage of the ceramic balls.

The spent shale particles exit the accumulator vessel and are transferred through a heat exchanger and spent shale cooler 26 to cool the spent shale particles. The heat recovered from the spent shale cooler can be utilized to produce steam for plant use.

The ceramic balls separated in the accumulator vessel are recovered from the accumulator vessel and transported to a ball elevator 30. In the ball elevator, the ceramic balls are lifted by a bucket elevator to the gas-fired ball heater 20. The gas-fired ball heater is a direct contact heat exchanger designed to heat the ceramic balls to about 1270° F.

The hot flue gas from the ball heater can be used to lift the sized crude oil shale particles in the fluidized bed lift pipe 12. That is, the hot flue gas 13 from the ball heater is used to lift the oil shale particles to a point at which such particles can subsequently flow by gravity into the pyrolysis drum. In so doing, the flue gas also preheats the oil shale particles to approximately 500° F.

The shale oil vapor produced in the pyrolysis drum by the pyrolysis of the oil shale particles is separated in the accumulator vessel and transported to a condenser 28 wherein the condensable material in the vapor is condensed to form a whole shale oil. Such whole shale oil produced by this method is referred to as Tosco II process-produced whole crude shale oil as disclosed in U.S. Pat. No. 3,025,223 (hereinafter sometimes referred to as Tosco II process-produced shale oil). The pour point of the whole crude shale oil produced by the Tosco II retorting process is generally from about 55° to about 70° F.

Figure 2:
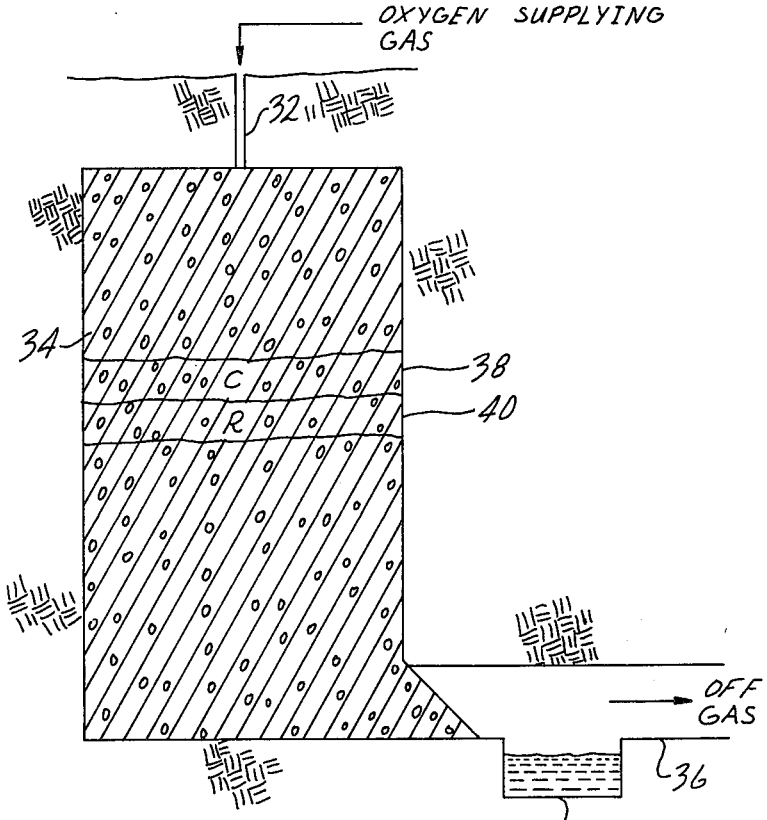
FIG. 2 illustrates schematically in vertical cross-section an in situ oil shale retort for producing shale oil.

Such a whole shale oil can be difficult to pump through pipelines. Such a whole shale oil is especially difficult to pump through pipelines during winter as the temperatures in the locations where oil shale is found generally are below 55° F. For example, in winter it is desirable to provide a shale oil having a pour point no higher than about 20° F. if such shale oil is to be transported through available pipelines. To lower the pour point of the Tosco II process-produced shale oil, it is blended with a crude shale oil produced by in situ retorting of oil shale in a subterranean in situ oil shale retort. Preferably, the in situ process-produced crude shale oil is produced by the modified in situ shale oil recovery process developed by Occidental Petroleum Corporation as disclosed on pp. 108–110 of the *Synthetic Fuels Data Handbook.* FIG. 2 represents a schematic of such a modified in situ retort having utility in the shale oil recovery process developed by Occidental Petroleum Corporation. Such an in situ oil shale retort can be formed by many methods, such as the methods disclosed in U.S. Pat. Nos. 3,661,423; 4,043,595; 4,043,596; 4,043,597; and 4,043,598, the entire disclosures of each are incorporated herein by this reference.

To prepare a modified in situ oil shale retort, formation from within the boundaries of a retort site is excavated to form at least one void, leaving a remaining portion of unfragmented formation within the boundaries of the retort being formed. The remaining portion of unfragmented formation is explosively expanded towards such a void to form a fragmented permeable mass of formation particles containing oil shale within the retort boundaries.

One method of forming an in situ oil shale retort is by excavating at least one columnar void, such as in the form of a vertical slot, for providing vertical free faces of formation on opposite sides of the slot in the retort site. Blasting holes are drilled in the unfragmented formation adjacent the vertical slot and parallel to such a free face. Explosive is loaded into the blasting holes and detonated to explosively expand formation adjacent the slot toward the vertical free faces to form a fragmented permeable mass of formation particles containing oil shale within the in situ retort being formed. Further details of techniques for forming a fragmented mass employing a columnar void are disclosed in aforementioned U.S. Pat. Nos. 4,043,595 and 4,043,596.

In another method of forming in situ oil shale retorts, the void excavated within the retort site can be a horizontal void for providing horizontal free faces of formation toward which unfragmented formation within the retort site can be explosively expanded. After completion of the excavation of such horizontal void or voids, vertical blasting holes are drilled through the unfragmented formation remaining within the retort site. Explosive is placed into the blasting holes and subsequently detonated for explosively expanding the unfragmented formation toward the horizontal free face. Further details of techniques for forming retorts using such horizontal voids are more fully described in the aforementioned U.S. Pat. Nos. 4,043,597 and 4,043,598.

After the fragmented mass is formed, the final preparation steps are producing liquid and gaseous products are carried out. With regard to FIG. 2, these steps include drilling a plurality of feed gas inlet passages 32 downwardly to the fragmented mass 34 so that an oxygen supplying gas can be introduced to the fragmented mass during retorting operations. Alternatively, the upper ends of blasting holes used in forming the fragmented mass can be cleaned and used for introducing an oxygen supplying gas to the retort. The fragmented mass connects to a product removal drift 36 at the lower end of the fragmented mass.

During retorting operations, formation particles at the top of the fragmented mass are ignited to establish a combustion zone 38. An oxygen supplying gas, such as air, is introduced to the combustion zone through the inlet passages. The oxygen supplying gas introduced to the fragmented mass maintains the combustion zone and advances it downwardly through the fragmented mass. Combustion gas produced in the combustion zone passed through the fragmented mass preheating the fragmented mass and establishing a retorting zone 40 on the advancing side of the combustion zone. In the retorting zone, kerogen in the fragmented mass is converted to liquid and gaseous products. As the retorting zone moves downwardly through the fragmented mass, liquid and gaseous products are released from the fragmented formation particles. A sump 42 in a portion of the removal drift connected to the lower end of the fragmented mass, collects liquid products produced during operation of the retort. Off gas is also withdrawn through the drift to above ground.

As an example of a practice of such a process for producing in situ crude shale oil, an in situ oil shale retort about 120 feet square in horizontal cross section and about 270 feet high was prepared in the southern part of the Piceance Creek Basin region of Colorado. The in situ oil shale retort was referred to as "Retort 4." Retort 4 contained a fragmented permeable mass of particles of formation containing oil shale from the Piceance Creek Basin. The average Fischer Assay of oil shale in the fragmented mass was less than about 15 gallons per ton.

An upper portion of the fragmented mass in the in situ oil shale retort was ignited by introducing air and liquefied petroleum gas (LPG) and burning the resultant mixture. Combustion of the LPG raised a substantial portion of the formation particles in the upper portion of the fragmented mass to an ignition temperature of such particles and established a combustion zone. An oxygen supplying gas was introduced to an upper portion of the fragmented mass in the retort for advancing the combustion zone downwardly through the fragmented mass. Off gas was withdrawn from a lower portion of the fragmented mass and the resultant downwardly flow of gas through the in situ retort carried heat of combustion downwardly from the combustion zone into a retorting zone.

Thermal decomposition of kerogen in oil shale particles in the retorting zone yielded gaseous and liquid products. Crude shale oil and water were withdrawn from the bottom of the fragmented mass in the retort. The off gas withdrawn from the bottom of the retort included gaseous products.

Since an operating in situ oil shale retort is relatively long with regard to the distance the retorting zone and combustion zone have to travel, for example a few hundred feet, the liquid products produced during retorting and which percolate through the fragmented permeable mass on the advancing side of the retorting zone have a long residence time in the fragmented mass. Such liquid products encounter and are exposed to the surface area of the formation particles in the fragmented mass over which the liquid products flow. Thus, the path length through the fragmented mass traversed by the liquid product between the retorting zone and the location where the crude shale oil is withdrawn from the fragmented mass can be quite long.

As retorting continues, the path length through the fragmented mass traversed by the liquid products between the retorting zone and the location where crude shale oil is withdrawn, progressively decreases and conditions in the fragmented mass on the advancing side of the retorting zone change. One effect of these changes is that the pour point of the crude shale oil withdrawn from the fragmented mass gradually increases. Another is that the paraffin content of the shale oil gradually increases.

The retorting operation was conducted in Retort 4 for about five and one-half months, during which time the retorting zone advanced downwardly through more than two hundred feet of the fragmented mass in the retort. The average rate for advancement of the retorting zone through the retort was calculated to be about 1.2 feet per day.

The following Table I lists the pour points of the crude shale oil withdrawn from Retort 4 at various times during the retorting process.

TABLE I

| Pour Point of Retort 4 Shale Oil | |
|---|---|
| Date Produced | Pour Point °F. 5° F. |
| 1/22 | −10 |
| 1/29 | −20 |
| 2/10 | −10 |
| 2/19 | −15 |
| 2/26 | −10 |
| 3/4 | −5 |
| 3/11 | 0 |
| 3/18* | 30 |
| 3/26* | 20 |
| 4/1 | 15 |
| 4/8 | 15 |
| 4/15 | 10 |
| 4/22 | 10 |
| 4/29 | 20 |
| 5/6 | 25 |
| 5/13* | 40 |
| 5/20* | 50 |

*During these periods the retort inlet mixture did not contain steam.

Figure 6:
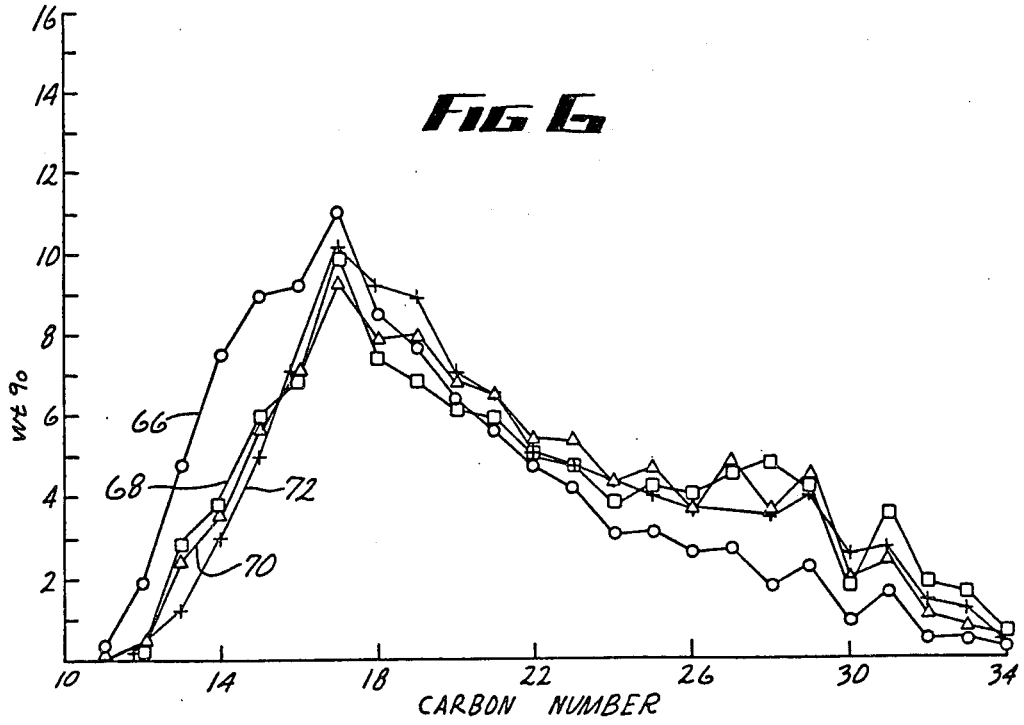
FIG. 6 is a graph of the paraffin distribution from an in situ oil shale retort as a function of time of retorting.

FIG. 6 illustrates the relation of N-paraffin content by carbon number of crude shale oil recovered from Retort 4 as a function of time. The curve 66, with the points represented by circles, is a curve of the distribution of N-paraffin in a crude shale oil recovered from Retort 4 on January 22. The curve 68, having points represented by squares is for a crude shale oil recovered on February 26. The curve 70, having points represented by triangles, is for a crude shale oil recovered on April 15. The curve 72, having points represented by crosses, is for a crude shale oil recovered on May 20.

The points along the curves in FIG. 6 were determined by gas chromatography to be as follows:

| C No. | 1/22 | 2/26 | 4/15 | 5/20 |
|---|---|---|---|---|
| 12 | 1.9 | 0.3 | 0.3 | 0.3 |
| 13 | 4.7 | 2.8 | 2.4 | 1.2 |
| 14 | 7.5 | 3.8 | 3.5 | 2.9 |
| 15 | 9.0 | 5.9 | 5.7 | 4.9 |
| 16 | 9.2 | 6.8 | 7.2 | 7.0 |
| 17 | 11.0 | 9.9 | 9.2 | 10.1 |
| 18 | 8.5 | 7.4 | 7.8 | 9.2 |
| 19 | 7.6 | 6.8 | 7.9 | 8.9 |
| 20 | 6.4 | 6.1 | 6.8 | 7.0 |
| 21 | 5.6 | 5.8 | 6.5 | 6.5 |
| 22 | 4.7 | 4.8 | 5.3 | 5.2 |
| 23 | 4.2 | 4.6 | 5.3 | 4.7 |
| 24 | 3.0 | 3.8 | 4.3 | 4.3 |
| 25 | 3.1 | 4.2 | 4.6 | 4.0 |
| 26 | 2.6 | 4.0 | 3.6 | 3.6 |
| 27 | 2.7 | 4.5 | 4.7 | 3.5 |
| 28 | 1.8 | 4.7 | 3.6 | 3.5 |

-continued

| C No. | 1/22 | 2/26 | 4/15 | 5/20 |
|---|---|---|---|---|
| 29 | 2.3 | 4.2 | 4.4 | 4.0 |
| 30 | 0.9 | 1.7 | 1.9 | 2.5 |
| 31 | 1.6 | 3.5 | 2.4 | 2.7 |
| 32 | 0.4 | 1.8 | 1.0 | 1.3 |
| 33 | 0.4 | 1.6 | 0.7 | 1.2 |
| 34 | 0.3 | 0.6 | 0.4 | 0.5 |
| | 99.4 | 99.6 | 99.5 | 99.0 |
| $C_{12}$–$C_{20}$ | 65.8 | 49.8 | 50.8 | 51.5 |
| $C_{21}$–$C_{34}$ | 33.6 | 49.8 | 48.7 | 47.5 |

It can be seen from FIG. 6 that as the time of operation of the in situ oil shale retort increases, and the path of travel of the liquid products decreases, there is a decrease in the concentration of $C_{12}$ to $C_{18}$ N-paraffins and an increase in the concentration of $C_{22}$ to $C_{30}$ N-paraffins. The increase in amount of higher weight N-paraffins and decrease in amount of lower weight N-paraffins correlates with the increase in pour point of crude shale oil with time as shown in the above Table I.

Three other in situ oil shale retorts have been prepared and retorted by generally similar techniques. These in situ oil shale retorts are identified as Retorts 1, 2 and 3, respectively. Each of these retorts had a square horizontal cross section of about 1,000 square feet. Retort 1 had a height of about 72 feet. Retort 2 had a height of about 94 feet. Retort 3 had a height of about 113 feet. Each of the retorts contained a fragmented permeable mass of particles containing oil shale from the Piceance Creek Basin. The fragmented mass in each retort was retorted by the process described hereinabove.

Figure 3:
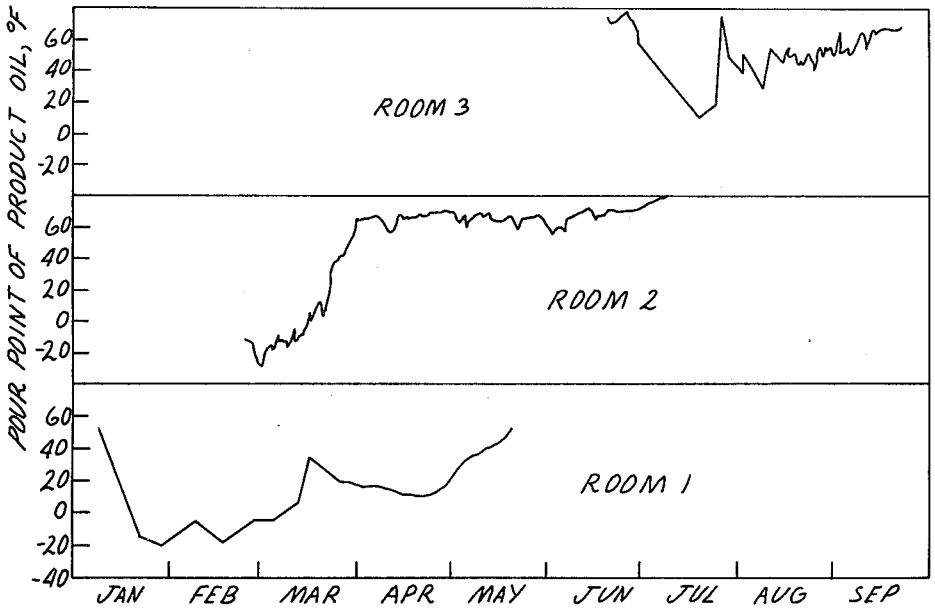
FIG. 3 is a graph of the pour point of crude shale oil withdrawn from an in situ oil shale retort as a function of time of retorting.

Generally, shale oil produced by in situ retorting, as described above, can have a pour point in the range of about a −30° to about 70° F. FIG. 3 shows the pour point of crude shale oil withdrawn from Retorts 2, 3 and 4 as a function of time. Pour points were measured according to the procedure of ASTM D97. The generally upward trend of pour point with time of retorting a given retort is clearly shown. The graphs in FIG. 3 show that during a considerable period of operation of an in situ oil shale retort, the shale oil produced can have a pour point lower than 20° F.

Crude shale oil produced by in situ oil shale retorting by processes as hereinabove described can be utilized for blending with Tosco II process-produced crude shale oil to provide a shale oil composition having a pour point lower than the Tosco II process-produced shale oil. The term "in situ process-produced crude shale oil" and its equivalent expressions used herein refers to a shale oil recovered from an in situ oil shale retort which has not been otherwise processed except for water removal and/or emulsion breaking. The use of an in situ process-produced shale oil which has been "processed" more than in situ process-produced crude shale oil may be undesirable. For example, best treating an in situ process-produced crude shale oil can raise the pour point of the shale oil and since the process herein is directed to lowering the pour point of a Tosco II process-produced shale oil, it would be undesirable to use such a heat-treated shale oil in the process herein. An in situ process-produced crude shale oil can be blended with a Tosco II process-produced crude shale oil to form a shale oil composition having a pour point at about the pour point of the in situ process-produced crude shale oil or having a pour point below the pour point of the in situ process-produced crude shale oil.

The process herein is practiced by blending a shale oil produced from a Tosco II retorting process with a shale oil produced from an in situ retorting process. The two shale oils are blended in relative amounts sufficient for providing a blended shale oil composition having a desirable pour point. The amounts of the two shale oils can be any amount of the two shale oils which will provide such a desirable pour point. In addition, the relative amounts of the two shale oils will depend upon the pour points of the individual shale oils.

It has been found that the shale oil composition formed upon blending a shale oil produced from a Tosco II retorting process and a shale oil produced from the in situ retorting process can exhibit a pour point lower than either of the individual shale oils. To provide such a blended shale oil composition having a pour point lower than either of the individual shale oils, the shale oils are preferably blended in about a 1:1 ratio by volume. If the ratio of the in situ process-produced shale oil to Tosco II process-produced shale oil is greater than such a 1:1 ratio, the blended shale oil composition exhibits a pour point lower than the pour point of either of the individual shale oils.

The following examples were conducted to measure the pour points and viscosities of blends of shale oils produced by in situ retorting and Tosco II retorting processes.

EXAMPLE I

A crude oil shale obtained from the above-described in situ oil shale retort designated as Retort 4 was carefully blended in varying proportions with a sample of a crude shale oil produced from a Tosco II oil shale retorting process. The Tosco II process-produced shale oil was produced at Parachute Creek, Colo., in 1972.

The two shale oils were blended in the following proportions which are given as percentage by volume of the blended shale oil composition. The determined viscosities are listed for each of the blended shale oil compositions. The viscosities were determined by the standard Saybolt and Brookfield viscosity-determining techniques.

Also given below is the average pour point of the blended shale oil compositions.

TABLE II

| Volume % | | Saybolt Viscosity | Brookfield Viscosity | |
|---|---|---|---|---|
| Retort 5 Shale Oil | Tosco II Shale Oil | at 100° F. (Centistokes) | at 100° F. (Centistokes) | Pour Point |
| 75 | 25 | 28.3 | 28.1 | 12 |
| 67 | 33 | 28.3 | 28.3 | 6 |
| 50 | 50 | 28.3 | 27.5 | 18 |
| 0 | 100 | 28.3 | 25.8 | 65 |
| 100 | 0 | 28.3 | 28.6 | 18 |

The crude shale oil from the Room 4 in situ retort, used in this example, was itself a blend of crude shale oil samples recovered from the in situ retort on March 18, March 28, April 1 and April 8. The determined pour points were determined by ASTM pour point techniques.

As can be determined by the above Table II, very little difference in viscosity was observed between the blends of shale oil. The Brookfield viscosity determinations were determined at a shear rate of 80 reciprocal seconds.

As can be seen from the above Table II, the Retort 4 in situ process-produced shale oil exhibited pour point depressant qualities when blended with the Tosco II process-produced shale oil. Surprisingly, the blended shale oil compositions, wherein the ratios of in situ process-produced shale oil to Tosco II process-produced shale oil were 75:25 and 67:33, exhibited pour points lower than either the in situ process-produced Retort 4 shale oil or the Tosco II process-produced shale oil. Even at a 1:1 ratio, the blended shale oil composition exhibited a pour point equivalent to the in situ process-produced Retort 4 shale oil alone.

EXAMPLE II

A blended shale oil composition was formulated by blending a Tosco II process-produced shale oil with an in situ process-produced shale oil from the above-identified Retort 4 in situ oil shale retort. The Retort 4 shale oil was dated May 13. The blended shale oil composition comprises 33.3% by volume, the Tosco II process-produced shale oil and 67.7% by volume the in situ process-produced shale oil.

The blended shale oil composition exhibited a pour point upon three separate pour point analyses of 45° F., 50° F. and 50° F. for an average pour point of 48.3° F. The in situ shale oil produced in Retort 4 had a pour point as determined in two separate analyses of 55° F. and 50° F. The Tosco II process-produced shale oil had a pour point of 65° F.

The results of the blending of the two shale oils provided a shale oil composition exhibiting a pour point equal to or lower than the pour point of the Retort 4 in situ process-produced shale oil. Thus, the blended shale oil composition exhibits a pour point substantially equivalent to the pour point of the in situ process-produced shale oil. The in situ process-produced shale oil thus exhibits a characteristic that it can absorb a substantial quantity of a higher pour point shale oil without significantly affecting the pour point characteristics and properties of the in situ process-produced shale oil.

EXAMPLE III

Another blended shale oil composition was formulated by blending an above-ground retorted shale oil recovered from a Tosco II retorting process with an in situ shale oil produced from an in situ oil shale retort designated as Retort 1. Retort 1 had characteristics as described above.

The two shale oils were blended in a ratio of 1:1 by volume such that the blended shale oil composition comprised about 50% by volume the in situ process-produced shale oil and about 50% by volume the Tosco II process-produced shale oil. The in situ process-produced shale oil exhibited a pour point of about 15° F. The Tosco II process-produced shale oil exhibited a pour point of about 65° F. When the two shale oils were blended in a 1:1 ratio by volume, the blended shale oil compositions exhibited a pour point of about 10° to 15° F. Thus, the Retort 1 shale oil also has a utility as a pour point depressant when blended with a Tosco II process-produced shale oil as the resulting blended shale oil composition exhibited a pour point less than the pour point of either of the individual shale oils.

The above examples illustrate that the in situ process-produced shale oil produced by advancing a combustion zone through a fragmented mass of formation particles in a subterranean in situ oil shale retort by introducing an oxygen-supplying gas into the fragmented mass on the trailing side of the combustion zone and withdrawing an off gas from the fragmented mass on the advancing side of the combustion zone exhibits a pour point depressant property when blended with a Tosco II process-produced shale oil. The pour point depressant capability is apparently not attributable to the mere dilution of the Tosco II process-produced shale oil by the in situ process-produced shale oil. For example, if the lowering of the pour point of the Tosco II process-produced shale oil were merely the result of dilution of the Tosco II process-produced shale oil, it would be expected that the pour point exhibited by the blended shale oil composition would be midway between the individual crude shale oils. However, such a result is not obtained upon blending the Tosco II process-produced shale oil with the in situ process-produced shale oil. The pour point of the blended composition can be about or lower than the pour point exhibited by the in situ process-produced shale oil.

Apparently the pour point lowering and pour point depressant characteristics of the in situ process-produced shale oil is unique to the in situ process-produced shale oil and, in particular, is unique to a blend of the in situ process-produced shale oil with a Tosco II process-produced shale oil. Comparative testing was conducted to determine the effect of blending an in situ process-produced shale oil recovered from Retort 1 above described with shale oils produced by other above-ground retorting processes.

COMPARATIVE EXAMPLE I

A crude shale oil recovered from Retort 1 having a pour point of about 5° F. was blended in a manner to provide a 1:1 ratio by volume, or 50% by volume mixture, of the in situ shale oil with a crude shale oil produced by the above-ground retorting process described as the Paraho Direct process. The shale oil from the Paraho Direct process had a pour point between about 80° to 90° F. The blended shale oil composition exhibited a pour point of about 50° F., about midway between the pour points of the two shale oils.

COMPARATIVE EXAMPLE II

A crude shale oil recovered from Retort 1 having a pour point of about 5° F. was blended in a 1:1 ratio by volume with a crude shale oil produced by the Paraho Indirect retorting process. The shale oil from the Paraho Indirect process had a pour point between about 80° to 90° F. The blended shale oil composition exhibited a pour point of about 45° F., about midway between the pour points of the two shale oils.

COMPARATIVE EXAMPLE III

A crude shale oil recovered from Retort 1 having a pour point of about 5° F. was blended with a crude shale oil produced from the Laramie 150-ton retort. The shale oil from the Laramie retort had a pour point of about 80° to 90° F. The blended shale oil composition comprised 50% by volume of the in situ shale oil and 50% of the Laramie shale oil. The blended shale oil composition exhibited a pour point of about 40° F., about midway between the pour points of the two shale oils.

Comparative testing was also conducted by blending various above-ground process-produced shale oils to determine if any of such shale oils exhibited a pour point depressant characteristic when blended with another above-ground retorting process-produced shale oil. In such comparative testing, a Tosco II process-produced shale oil was blended with a Paraho direct and indirect technique-produced shale oil. In addition, a Tosco II process-produced shale oil was blended with shale oil recovered from the Laramie 150-ton retort. In none of these comparative tests was there any significant decrease in the pour point of the blended shale oil composition over that of the individual shale oils comprising the blended shale oil composition.

These tests were conducted for comparison purposes as it would generally be undesirable to blend the shale oils. It is undesirable to blend these above-ground, process-produced shale oils as all of the individual shale oils exhibit a relatively high pour point. Thus, as it was found and as it was expected, the pour points of these blended shale oil compositions remained relatively high and were about midway between the pour points of the individual shale oils comprising the blended shale oil composition.

A crude shale oil produced by the in situ retorting of oil shale is preferably utilized in the process herein. A crude in situ process-produced shale oil is preferably utilized as it exhibits a generally low pour point and it has been found that the pour point of crude shale oil produced by in situ retorting increases when the crude shale oil is thermally treated such as by heating to temperatures approaching 200° C. The pour point has also been found to increase even when the thermal treatment consists of heating the crude shale oil under total reflux conditions so as to prevent loss of light ends. It is, therefore, apparent that a shale oil produced by an in situ process is a complex, chemically active system.

Although not to be bound by the theory herein, it is believed that pour points of shale oil are primarily determined by the temperature at which dissolved materials significantly crystallize out of solution in the shale oil. These crystals cross-link and form a three-dimensional matrix which traps the remaining liquid and prevents flow of the liquid shale oil. Any phenomenon which inhibits or alters either the rate or the dimensional characteristics of crystal growth, can affect the pour point of shale oil.

One phenomenon which is believed to influence crystal growth and thereby also the pour point of shale oil, is the distribution of paraffins in the crude shale oils. That is, the molecular weight distribution of paraffin waxes in the crude shale oils is believed to affect the pour point of the crude shale oils. It is believed that wax crystal formation is inhibited when paraffin waxes of different molecular weights attempt to co-crystallize. It is believed that crude shale oils having a wide paraffin wax molecular weight distribution but the same average paraffin wax molecular weight, may be expected to have lower pour points than crude shale oils having a narrower paraffinic wax molecular weight distribution. The mixing of the in situ process-produced crude shale oil and the Tosco II process-produced shale oil can represent a broadening of the molecular weight distribution of the paraffinic waxes in the blended shale oil composition over that of either crude shale oil.

Figure 4:
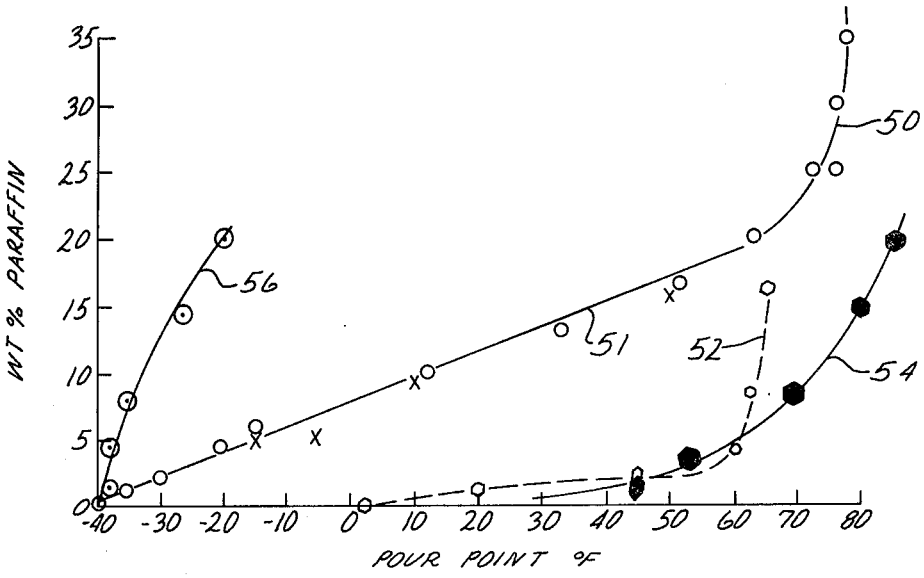
FIG. 4 is a graph of the pour points of crude shale oils and blended shale oil compositions as a function of the paraffin content of the shale oils.

The effects of paraffins and, in particular, N-paraffins present in crude shale oils on the pour points of such crude shale oils was investigated. During the course of the investigation an in situ process-produced crude shale oil was dewaxed to form a fraction containing N-paraffins and a dewaxed raffinate. A Tosco II process-produced shale oil was also dewaxed forming a dewaxed raffinate phase and a paraffinic phase. After separation of the various phases, the N-paraffin phase extracted from the crude shale oil produced by the in situ retorting process was blended with the dewaxed raffinate phase of the Tosco II process-produced shale oil. Similarly, the N-paraffin phase from the crude Tosco II process-produced shale oil was mixed with the dewaxed raffinate phase of the in situ process-produced shale oil. FIG. 4 is a graphical representation showing the effect of N-paraffins on shale oil pour point.

With regard to FIG. 4, five curves are illustrated (curves 50 and 51 overlap in FIG. 4). Each of the curves shows the relationship of paraffin content on shale oil pour point. The first curve designated as curve 50 and represented by the circles is a curve characteristic of crude shale oil from the Room 1 in situ oil shale retort.

The portion of the curve 50 designated as the curve 51 and represented by the points shown as x's is a characteristic curve of the pour point for shale oil from the Room 4 in situ oil shale retort. As can be seen from the curves 50 and 51, the pour points as a function of weight percent of paraffins for a shale oil produced by in situ retorting techniques as herein described, are substantially colinear. Thus, the pour point for in situ process-produced shale oils are substantially similar regardless of the size of the in situ retort from which the shale oil is recovered.

The curve 52 designated by the points represented by hexagons is the curve for a shale oil produced by the Tosco II retorting process. As can be seen from a comparison of the curve 50 with the curve 52, the Tosco II process-produced shale oil has a higher pour point at the same weight percent paraffin than does the in situ process-produced shale oil.

The curve 54, represented by the solid hexagons, is a curve which represents a blend of a paraffinic fraction from an in situ process-produced shale oil and a dewaxed Tosco II process-produced shale oil raffinate. A shale oil recovered from the Room 1 in situ retort was dewaxed and the paraffin fraction was blended with a dewaxed raffinate phase of Tosco II process-produced shale oil. As can be seen from the curve 54, the paraffins in the in situ process-produced shale oil have the effect of increasing the pour point of the dewaxed Tosco II process-produced shale oil.

The curve 56 represented by the circles having a dot in their center is a curve representative of the pour point as a function of the paraffin content for a shale oil blend produced by blending a dewaxed raffinate produced from dewaxing crude shale oil from the Room 1 in situ oil shale retort and a paraffin fraction recovered while dewaxing a Tosco II process-produced crude shale oil. As can be seen by the curve, the Room 1 raffinate which had the N-paraffins removed exhibits the ability to accept the paraffins present in the Tosco II process-produced shale oil and still retain a substantially reduced shale oil pour point. Thus, the N-paraffins present in the Tosco II process-produced crude shale oil have a different effect than the N-paraffins present in the in situ process-produced shale oil. The N-paraffins present in the Tosco II process-produced shale oil do not raise the pour point of the dewaxed shale oil raffinate to the pour point of a crude shale oil produced by in situ retorting having the same percentage N-paraffins. For example, for the in situ dewaxed raffinate having 20% Tosco II process-produced paraffins, the pour point is about −20° F. For a crude shale oil produced by the in situ retorting of oil shale wherein the weight percent of N-paraffins is about 20%, the pour point is about 60° F.

The results of the comparative studies illustrated in FIG. 4 indicates that the in situ process-produced shale oil contains compounds which make it much less susceptible to pour point degradation than the Tosco II process-produced shale oil. The difference in the influence of Tosco II paraffins on the Tosco II and Room 1 shale oils is extreme, with better than an 80° F. difference existing between the two dewaxed raffinates when each contain 14% by weight Tosco II paraffins.

Other observations which can be derived from FIG. 4 are that the pour point appears to be a linear function with regard to paraffin content. The presence, therefore, of N-paraffins influences the shale oil pour points. The Tosco II N-paraffins exhibit a mild and relatively unimportant effect on the in situ process-produced shale oil pour points. The N-paraffins from the in situ process-produced shale oil degrades the Tosco II shale oil pour points to a greater extent than the N-paraffins naturally contained in the Tosco II process-produced shale oil. The dewaxed raffinate from the in situ process-produced shale oil has superior pour point characteristics than those of the dewaxed raffinate from the Tosco II process-produced shale oil. Both the pour point and the rate of change of pour point with paraffin content depend on which paraffin is mixed with which dewaxed raffinate. Apparently, a maximum paraffin loading in shale oil exists beyond which further degradation of pour point does not occur.

The results shown in FIG. 4 also illustrate that both the N-paraffins and the dewaxed raffinate shale oils influence pour point. It is clear that massive changes in pour point can be caused by the presence of only small amounts of paraffins in some shale oils such as the Tosco II process-produced shale oil. It is particularly interesting that the paraffins from the Tosco II process-produced shale oil had little effect on the in situ process-produced shale oil raffinate. This is consistent with the observation that mixtures of a Tosco II process-produced crude shale oil having relatively high pour point and a lower pour point in situ process-produced crude shale oil are blended to produce a shale oil composition having a pour point equal to or lower than that of the in situ process-produced crude shale oil.

To support an understanding of the above data with regard to the effect of N-paraffins on shale oil pour point, the N-paraffin content of a number of shale oils produced from differing oil shale retorting processes, were characterized by simulated boiling point carbon numbers determined by gas chromatography. The studies were conducted on N-paraffins in the shale oil recovered from the Room 4 in situ oil shale retort, shale oil produced by the Tosco II retorting process and a shale oil produced by the Paraho Indirect process.

Figure 5:
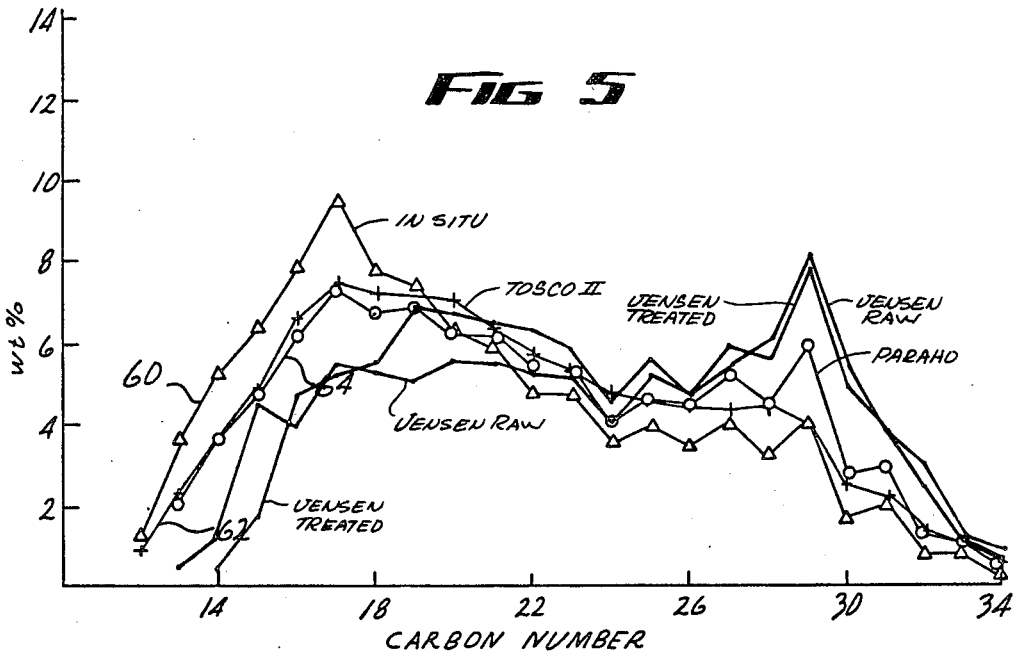
FIG. 5 is a graph of the paraffin distribution in shale oils as a function of percentage by weight.
Figure 5A:
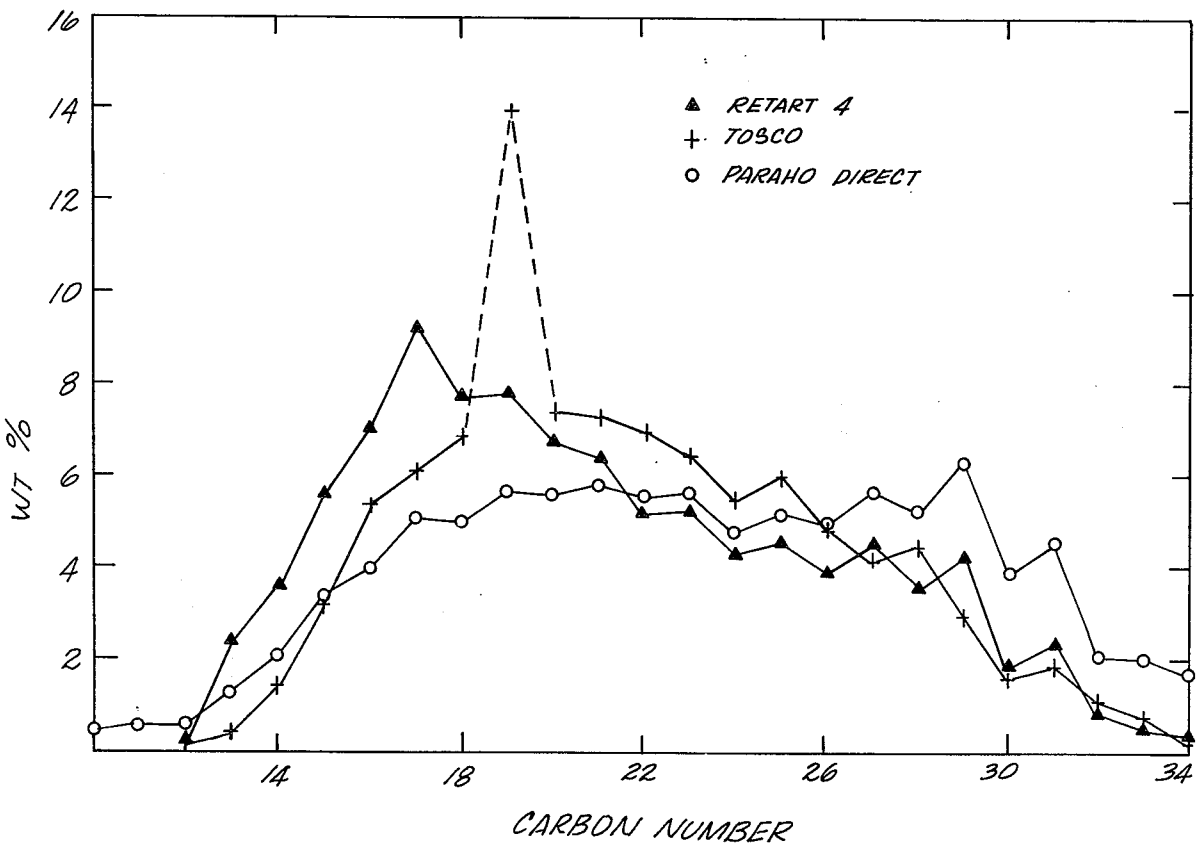
FIG. 5A is a graph of the paraffin distribution in shale oils as a function of percentage by weight determined independently from that shown in FIG. 5.

The distribution of the N-paraffins by carbon number in the various crude shale oils is shown in FIGS. 5 and 5A. The curve 60 in FIG. 5 represents the N-paraffins found in a crude shale oil recovered from the Room 4 in situ oil shale retort. The points along the curve 60 are shown as triangles. The curve 62 in FIG. 5 represents the N-paraffin in a crude shale oil produced by the Tosco II retorting process. The points along the curve 62 are represented by crosses. The third curve 64 represents the N-paraffins present in a crude shale oil produced by the Paraho indirect process. The points along the curve 64 are shown as circles.

A separately conducted gas chromatographic analysis was conducted on the N-paraffins from the same shale oils shown in FIG. 5. The results of the second analysis are shown in FIG. 5A. The points along curve 61 are shown as triangles and relate to the in situ process-produced crude shale oil. Curve 63 shown by crosses represents the N-paraffins from the TOSCO II process. Curve 65 shown by circles represents the N-paraffins of the Paraho Indirect process crude shale oil.

The points along the curves in FIGS. 5 and 5A are given in the following Tables III and IV respectively. As can be seen, the in situ process-produced shale oil has an N-paraffin content which comprises less than 50% by weight of $C_{21}$ to $C_{34}$ N-paraffins.

TABLE III

| C No. | Weight Percent In-Situ | Tosco-II | Paraho |
|---|---|---|---|
| 12 | 1.3 | 1 | 1 |
| 13 | 3.7 | 2.3 | 2 |
| 14 | 5.3 | 3.7 | 3.7 |
| 15 | 6.5 | 4.8 | 4.7 |
| 16 | 7.8 | 6.7 | 6.2 |
| 17 | 9.5 | 7.5 | 7.3 |
| 18 | 7.8 | 7.3 | 6.7 |
| 19 | 7.5 | 7.2 | 6.8 |
| 20 | 6.3 | 7.1 | 6.3 |
| 21 | 6.0 | 6.4 | 6.2 |
| 22 | 4.7 | 5.8 | 5.5 |
| 23 | 4.7 | 5.4 | 5.4 |
| 24 | 3.6 | 4.7 | 4.1 |
| 25 | 4.0 | 4.6 | 4.7 |
| 26 | 3.5 | 4.5 | 4.5 |
| 27 | 4.0 | 4.4 | 5.3 |
| 28 | 3.3 | 4.5 | 4.6 |
| 29 | 4.1 | 4.0 | 6.0 |
| 30 | 1.7 | 2.5 | 2.8 |
| 31 | 2.0 | 2.3 | 3.0 |
| 32 | 0.8 | 1.4 | 1.4 |
| 33 | 0.8 | 1.1 | 1.1 |
| 34 | 0.3 | 0.6 | 0.6 |
| | 99.2 | 99.8 | 99.9 |
| $C_{12}$–$C_{20}$ | 55.7 | 47.6 | 44.7 |
| $C_{21}$–$C_{34}$ | 43.5 | 52.2 | 55.2 |
| $C_{26}$–$C_{34}$ | 20.5 | 25.3 | 29.3 |

TABLE IV

| C No. | Weight Percent In-situ | Tosco-II | Paraho |
|---|---|---|---|
| 12 | 0.3 | 0.2 | 0.6 |
| 13 | 2.4 | 0.5 | 1.3 |
| 14 | 3.6 | 1.4 | 2.1 |
| 15 | 5.6 | 3.2 | 3.5 |
| 16 | 7.2 | 5.4 | 4.0 |
| 17 | 9.3 | 6.1 | 5.1 |
| 18 | 7.7 | 6.9 | 5.0 |
| 19 | 7.8 | 7.3 (14)* | 5.7 |
| 20 | 6.8 | 7.5 | 5.6 |
| 21 | 6.4 | 2.3 | 5.8 |
| 22 | 5.2 | 7.0 | 5.5 |
| 23 | 5.3 | 6.5 | 5.6 |
| 24 | 4.3 | 5.5 | 4.8 |
| 25 | 4.6 | 6.0 | 5.2 |
| 26 | 4.0 | 5.0 | 5.0 |
| 27 | 4.6 | 4.2 | 5.7 |
| 28 | 3.6 | 4.5 | 5.3 |
| 29 | 4.4 | 3.0 | 6.4 |
| 30 | 1.9 | 1.7 | 4.0 |
| 31 | 2.4 | 1.9 | 4.6 |
| 32 | 0.9 | 1.1 | 2.2 |
| 33 | 0.6 | 0.8 | 2.1 |
| 34 | 0.5 | 0.3 | 1.8 |
| | 99.4 | 93.3 (100) | 96.9 |
| $C_{12}$–$C_{20}$ | 50.7 | 38.5 (45.2) | 32.9 |
| $C_{21}$–$C_{34}$ | 48.7 | 54.8 (54.8) | 64.0 |
| $C_{26}$–$C_{34}$ | 22.9 | 22.5 | 37.1 |

*This value was determined to be 14%, but it is believed to be due to an error in the analysis. An expected true value is believed to be the 7.3% value interpolated from the curve.

The distribution of the N-paraffins in the three shale oils shows that the N-paraffins in the in situ process-produced shale oil have a higher percentage of $C_{12}$ to $C_{20}$ compounds, and a lower percentage of $C_{20}$ to $C_{30}$ compounds than do either the Paraho or Tosco II N-paraffins.

With regard to FIG. 5, the distributions of the N-paraffins in the Paraho and Tosco II shale oils appear to be similar with only small differences in the percentages of the various N-paraffins present. One difference in the distribution of N-paraffins between the Tosco II and Paraho N-paraffins that can be noted from FIG. 5 is that the Paraho N-paraffins comprise a considerably flatter and wider distribution by carbon number than the Tosco II paraffins. The Paraho paraffins also contain somewhat less $C_{18}$ to $C_{24}$ and somewhat more $C_{24}$ to $C_{32}$ compounds than does the Tosco II shale oil.

In view of the similarities in the distributions of N-paraffins present in the three different types of shale oil, it is unexpected that blending in situ process-produced shale oil with Tosco II process-produced shale oil would have any significant effect on the pour point. Such unexpected results are further illustrated by the lack of significant impact on pour point of the blended shale oil composition when, as is shown in the aforementioned comparative examples, an in situ process-produced shale oil is blended with a Paraho process-produced shale oil or a Tosco II process-produced shale oil is blended with a Paraho process-produced shale oil.

The practice of the process herein can provide a blended shale oil composition having a pour point lower than the pour points of the shale oil components blended to form the shale oil composition. As the blended shale oil composition can have a significantly lower pour point than the Tosco II process-produced shale oil component, the process herein provides a method of lowering the pour point of such a Tosco II process-produced shale oil to make the transfer of such a Tosco II process-produced shale oil easier and more economical. The amount of lowering of the pour point of the Tosco II process-produced shale oil can be varied depending upon the conditions such as the weather and temperature at which the Tosco II shale oil is produced and along the route through which the Tosco II shale oil is to be transported. A blended shale oil composition can be formulated to suit the needs of a particular season or region. For example, the amount of in situ process-produced shale oil that is blended with the Tosco II shale oil can be varied to provide the desired amount of lowering of the pour point of the Tosco II process-produced shale oil. As discussed above, the in situ process-produced shale oil can absorb large quantities of the Tosco II process-produced shale oil and still provide a significant lowering of the pour point from that of the Tosco II process-produced shale oil to that exhibited by the blended shale oil composition. For example, as discussed above, a 1:1 ratio by volume of Tosco II process-produced shale oil and in situ process-produced shale oil produces a blended shale oil composition exhibiting a pour point below or near the pour point of the in situ process-produced shale oil.

Although the present invention has been described in terms of particular details and embodiments thereof, the particulars of the description are not intended to limit the invention, the scope of which is defined in the following claims.

What is claimed is:

1. A method for lowering the pour point of a shale oil produced from a Tosco II retorting process, the method comprising the steps of:

producing crude shale oil by in situ retorting of oil shale in a subterranean in situ oil shale retort containing a fragmented permeable mass of particles containing oil shale by advancing a combustion zone through the fragmented mass by introducing an oxygen-supplying gas to the fragmented mass on the trailing side of the combustion zone and withdrawing an off gas from the fragmented mass on the advancing side of the combustion zone, whereby gas flowing through the combustion zone transfers heat of combustion to a retorting zone in the fragmented mass on the advancing side of the combustion zone and wherein kerogen in oil shale in the retorting zone is decomposed to produce gaseous and liquid products including crude shale oil;

withdrawing such crude shale oil from such in situ oil shale retort;

blending a portion of such crude shale oil with a sufficient amount of a shale oil produced from a Tosco II retorting process to produce a blended shale oil cmposition having a pour point lower than the pour point of such shale oil produced from the in situ retorting process.

2. A method for lowering the pour point of shale oil produced from a Tosco II retorting process, the method comprising:

blending with such a Tosco II process-produced shale oil a crude shale oil recovered from in situ retorting of oil shale in a subterranean in situ oil shale retort containing a fragmented permeable mass of particles containing oil shale by advancing a combustion zone through the fragmented mass by introducing an oxygen-supplying gas to the fragmented mass on the trailing side of the combustion zone and withdrawing an off gas from the fragmented mass on the advancing side of the combustion zone, whereby gas flowing through the combustion zone tranfers heat of combustion to a retorting zone in the fragmented mass on the advancing side of the combustion zone and wherein kerogen in oil shale in the retorting zone is decomposed to produce gaseous and liquid products including crude shale oil, the ratio of the Tosco II process-produced shale oil to the in situ process-produced shale oil being no greater than 1:1.

3. A method for forming a reduced pour point shale oil composition, the method comprising the steps of:

producing crude shale oil by in situ retorting oil shale in a subterranean in situ oil shale retort containing a fragmented permeable mass of particles containing oil shale by advancing a combustion zone through the fragmented mass by introducing an oxygen-supplying gas to the fragmented mass on the trailing side of the combustion zone, and withdrawing an off gas from the fragmented mass on the advancing side of the combustion zone, whereby gas flowing through the combustion zone transfers heat of combustion to a rotorting zone in the fragmented mass on the advancing side of the combustion zone and wherein kerogen in oil shale in the retorting zone is decomposed to produce gaseous and liquid products including crude shale oil;

withdrawing such crude shale oil from such in situ oil shale retort;

producing crude shale oil by above-ground retorting of oil shale in a Tosco II retorting process by comminuting and sizing oil shale to a particle size of about minus one-half inch, preheating the sized oil shale particles to about 500° F., admixing the oil shale particles with heated ceramic balls, heated to about 1200° F., whereby kerogen in the oil shale particles is decomposed to produce gaseous and liquid products including crude shale oil;

recovering such crude shale oil from such Tosco II retorting process;

blending a portion of the crude shale oil from such in situ oil shale retort with a sufficient portion of the crude shale oil recovered from the Tosco II retorting process to produce a blended shale oil composition having a pour point lower than the pour point of the crude shale oil recovered from the in situ oil shale retort.

4. A blended shale oil composition comprising in admixture a crude shale oil recovered from an in situ oil shale retort and a crude shale oil recovered from a Tosco II retorting process wherein the crude shale oil recovered from an in situ oil shale retort is present in an amount sufficient for forming a blended shale oil composition having a pour point less than the pour point of the crude shale oil recovered from the in situ oil shale retort.

5. A blended shale oil composition as recited in claim 4 wherein the crude shale oil recovered from an in situ oil shale retort is produced by in situ retorting oil shale in a subterranean in situ oil shale retort containing a fragmented permeable mass of particles containing oil shale by advancing a combustion zone through the fragmented mass by introducing an oxygen-supplying gas to the fragmented mass on the trailing side of the combustion zone and withdrawing an off gas from the fragmented mass on the advancing side of the combustion zone, whereby gas flowing through the combustion zone transfers heat of combustion to a retorting zone in the fragmented mass on the advancing side of the combustion zone and wherein kerogen in oil shale in the retorting zone decomposes to produce gaseous and liquid products including crude shale oil.

6. A method for forming a reduced pour point shale oil composition, the method comprising the steps of:

producing crude shale oil by in situ retorting oil shale in a subterranean in situ oil shale retort containing a fragmented permeable mass of particles containing oil shale by advancing a combustion zone through the fragmented mass by introducing an oxygen-supplying gas to the fragmented mass on the trailing side of the combustion zone and withdrawing an off gas from the fragmented mass on the advancing side of the combustion zone, whereby gas flowing through the combustion zone transfers heat of combustion to a retorting zone in the fragmented mass on the advancing side of the combustion zone and wherein kerogen in oil shale in the retorting zone is decomposed to produce gaseous and liquid products including crude shale oil;

withdrawing such crude shale oil from such in situ oil shale retort;

producing crude shale oil by above-ground retorting of oil shale by comminuting and sizing oil shale to a particle size of about minus one-half inch, preheating the sized oil shale particles to about 500° F., admixing the oil shale particles with heated ceramic balls, heated to about 1200° F., whereby kerogen in the oil shale particles is decomposed to produce gaseous and liquid products including crude shale oil;

recovering such crude shale oil from such above-ground retorting process; and blending a portion of the crude shale oil from such in situ oil shale retort with a portion of the crude shale oil recovered from the above-ground retorting process to produce a blended shale oil composition having a pour point lower than the pour point of the crude shale oil recovered from the in situ oil shale retort.

7. A method for lowering the pour point of a shale oil produced from a TOSCO II retorting process, the method comprising the step of blending with such a TOSCO II process-produced shale oil a crude shale oil having a $C_{21}$ to $C_{34}$ N-paraffin content comprising less than about 50% by weight of the total N-paraffin content of the crude shale oil, the ratio of the shale oil produced from a TOSCO II retorting process to the crude shale oil is no greater than 1:1.

8. A method as recited in claim 7 wherein the crude shale oil blended with the TOSCO II process-produced shale oil comprises a shale oil having a $C_{12}$ to $C_{20}$ N-paraffin content comprising greater than about 50% by weight of the N-paraffin content of the crude shale oil.

9. A method for lowering the pour point of a first shale oil having a $C_{21}$ to $C_{34}$ N-paraffin content comprising less than about 50% by weight of the total N-paraffins present in the first shale oil by blending with such first shale oil a sufficient amount of a second shale oil having less than 26% by weight $C_{26}$ to $C_{34}$ N-paraffins and more than 50% by weight $C_{21}$ to $C_{34}$ N-paraffins to the total N-paraffins present in such second shale oil so that the blended shale oil has a pour point lower than the pour point of the first shale oil.

10. A method as recited in claim 9 wherein the first shale oil has a $C_{12}$ to $C_{20}$ N-paraffin content of greater than 50% by weight of the total N-paraffins present in the first shale oil.

11. A method as recited in claim 9 wherein the first shale oil has a pour point less than or equal to the pour point of the second shale oil.

12. A method as recited in claim 11 wherein the first shale oil has a pour point at least 10° F. less than the pour point of the second shale oil.

13. A blended shale oil composition comprising in admixture a crude shale oil recovered from an in situ oil shale retort and a crude shale oil recovered from a Tosco II retorting process, the ratio of the crude shale oil recovered from a Tosco II retorting process to crude shale oil recovered from an in situ oil shale retort being no greater than 1:1.

14. A blended shale oil composition as recited in claim 13 wherein the crude shale oil recovered from an in situ oil shale retort is produced by in situ retorting oil shale in a subterranean in situ oil shale retort containing a fragmented permeable mass of particles containing oil shale by advancing a combustion zone through the fragmented mass by introducing an oxygen-supplying gas to the fragmented mass on the trailing side of the combustion zone and withdrawing an off gas from the fragmented mass on the advancing side of the combustion zone, whereby gas flowing through the combustion zone transfers heat of combustion to a retorting zone in the fragmented mass on the advancing side of the combustion zone and wherein kerogen in oil shale in the retorting zone decomposes to produce gaseous and liquid products including crude shale oil.

* * * * *

UNITED STATES PATENT AND TRADEMARK OFFICE

CERTIFICATE OF CORRECTION

PATENT NO. : 4,437,519

DATED : March 20, 1984

INVENTOR(S) : Chang Yul Cha, Harry E. McCarthy

It is certified that error appears in the above-identified patent and that said Letters Patent is hereby corrected as shown below:

Column 8, line 9 "passed" should be -- passes --.
Column 10, line 57 "best" should be -- heat --.
Column 11, line 30 "oil shale" should be -- shale oil --.
Column 19, line 22, "cmposition" should be -- composition --.
Column 19, line 59, "rotorting" should be -- retorting --.
Column 21, line 36, "to" should be -- of --.

Signed and Sealed this

*Fourth* Day of *December 1984*

[SEAL]

*Attest:*

GERALD J. MOSSINGHOFF

*Attesting Officer* *Commissioner of Patents and Trademarks*